US006698862B1

(12) United States Patent
Choi et al.

(10) Patent No.: US 6,698,862 B1
(45) Date of Patent: Mar. 2, 2004

(54) METHOD AND APPARATUS FOR THERMAL INK JET DROP VOLUME CONTROL USING VARIABLE PREPULSES

(75) Inventors: Yungran Choi, Webster, NY (US); Dale Ims, Webster, NY (US); Narayan Deshpende, Penfield, NY (US); Juan Becerra, Altramont, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,407

(22) Filed: Jan. 16, 2003

(51) Int. Cl.[7] ..... B41J 29/38
(52) U.S. Cl. ..... 347/17
(58) Field of Search ..... 347/12, 15, 17

(56) References Cited

U.S. PATENT DOCUMENTS

| | | | | |
|---|---|---|---|---|
| 4,463,359 A | * | 7/1984 | Ayata et al. | 347/56 |
| 4,791,435 A | * | 12/1988 | Smith et al. | 347/140 |
| 5,519,417 A | * | 5/1996 | Stephany et al. | 347/14 |
| 5,917,509 A | * | 6/1999 | Becerra et al. | 347/11 |
| 5,969,730 A | * | 10/1999 | Inose et al. | 347/11 |
| 6,375,295 B1 | * | 4/2002 | Ghozeil et al. | 347/12 |
| 6,565,177 B1 | * | 5/2003 | Corrigan, III | 347/15 |

FOREIGN PATENT DOCUMENTS

| | | | | |
|---|---|---|---|---|
| EP | 0 496 525 A1 | * | 7/1992 | B41J/2/195 |
| EP | 0 505 154 A2 | * | 9/1992 | B41J/2/07 |

* cited by examiner

*Primary Examiner*—Stephen D. Meier
*Assistant Examiner*—Alfred E Dudding
(74) *Attorney, Agent, or Firm*—Oliff & Berridge, PLC

(57) ABSTRACT

A method and apparatus are providing for extending the drop volume control of a thermal ink jet print head. The print head has a plurality of drop ejectors, each of the plurality of drop ejectors has a heating element actuatable in response to input signals to eject an ink droplet from the print head. The method includes the steps of applying a plurality of print signals to the print head, the plurality of print signals corresponding to an image for the ink jet assembly to create, applying at least one pulse signal to the print head, and sequentially using the at least one pulse signal and the plurality of print signals to activate the heating elements so that the change in current remains small. In addition, the apparatus has a print data storage element that receives print data from a printer controller, a pulse data delay element that receives pulse data from either a print head controller or a previous drop ejector and sends the pulse data to a next drop ejector after a predetermined delay, a heating element and a checksum element that, when the data storage element contains print data, and the pulse data delay element contains pulse data, activates the heating element according to the print data and the pulse data.

20 Claims, 11 Drawing Sheets

| TEMPERATURE RANGE °C | $P_7$ | $S_7$ | $P_6$ | $S_6$ | $P_5$ | $S_5$ | $P_4$ | $S_4$ | $P_3$ | $S_3$ | $P_2$ | $S_2$ | $P_1$ | $S_1$ | $P_0$ |
|---|---|---|---|---|---|---|---|---|---|---|---|---|---|---|---|
| 25-29 | 0.2 | 0.6 | 0.2 | 0.6 | 0.2 | 0.6 | 0.2 | 0.6 | 0.2 | 0.6 | 0.3 | 0.6 | 0.3 | 0.6 | 2.0 |
| 30-34 | | | | | 0.3 | 0.6 | 0.3 | 0.6 | 0.3 | 0.6 | 0.2 | 0.6 | 0.2 | 0.6 | 2.0 |
| 35-39 | | | | | | | 0.3 | 0.7 | 0.3 | 0.6 | 0.2 | 0.6 | 0.2 | 0.6 | 2.1 |
| 40-44 | | | | | | | | | | | 0.4 | 0.8 | 0.2 | 0.6 | 2.2 |
| 45-49 | | | | | | | | | | | | | | | 2.6 |
| 50-54 | | | | | | | | | | | | | | | 2.4 |

FIG. 5

| TEMPERATURE RANGE °C | $P_7$ | $S_7$ | $P_6$ | $S_6$ | $P_5$ | $S_5$ | $P_4$ | $S_4$ | $P_3$ | $S_3$ | $P_2$ | $S_2$ | $P_1$ | $S_1$ | $P_0$ |
|---|---|---|---|---|---|---|---|---|---|---|---|---|---|---|---|
| 25-29 | 0.2 | 0.6 | 0.2 | 0.6 | 0.2 | 0.6 | 0.2 | 0.6 | 0.2 | 0.6 | 0.2 | 0.6 | 0.2 | 0.6 | 2.2 |
| 30-34 | | | | | 0.2 | 0.6 | 0.2 | 0.6 | 0.2 | 0.6 | 0.2 | 0.6 | 0.2 | 0.6 | 2.3 |
| 35-39 | | | | | | | | | 0.2 | 0.6 | 0.2 | 0.6 | 0.2 | 0.6 | 2.4 |
| 40-44 | | | | | | | | | | | | | 0.2 | 0.6 | 2.5 |
| 45-49 | | | | | | | | | | | | | | | 2.6 |
| 50-54 | | | | | | | | | | | | | | | 2.4 |

FIG. 6

METHOD AND APPARATUS FOR THERMAL INK JET DROP VOLUME CONTROL USING VARIABLE PREPULSES

BACKGROUND OF THE INVENTION

1. Field of Invention

This invention relates to methods and apparatus used in thermal ink jet printers.

2. Description of Related Art

A thermal ink jet print head selectively ejects droplets of ink from a plurality of drop emitters to create a desired image on an image receiving member, such as a sheet of paper. The print head typically comprises an array of the drop emitters that convey ink to the image receiving member. In a carriage ink jet print head, the print head moves back and forth relative to the image receiving member to print the image in swaths.

Alternatively, the array may extend across the entire width of the image receiving member to form a fullprint head. Fullprint heads remain stationary as the image receiving member moves in a direction substantially perpendicular to the array of drop emitters.

A thermal ink jet print head typically comprises a plurality of ink passageways, such as capillary channels. Each channel has a drop emitter and is connected to an ink supply manifold. Ink from the manifold is retained within each channel. Then, in response to an appropriate signal applied to a resistive heating element in each channel, the ink in a portion of the channel adjacent to the heating element is rapidly heated. Rapidly heating and vaporizing some of the ink in the channel creates a bubble that causes a quantity of ink, such as an ink droplet or a main ink droplet and smaller satellite drops, to be ejected from the emitter to the image receiving member. U.S. Pat. No. 4,774,530 to Hawkins, the disclosure of which is incorporated herein by reference in its entirety, shows a general configuration of a typical inkjet print head.

U.S. Pat. No. 4,791,435 to Smith et al., the disclosure of which is incorporated herein by reference in its entirety, discloses an ink jet system where a constant temperature of the print head is maintained by using the heating elements of the print head not only for ejecting ink but to maintain the temperature close to a predetermined value as well. The print head temperature is compared to thermal models of the print head to provide information for controlling the print head temperature. At low temperature, low energy pulses are sent to each channel, or nozzle, below the voltage threshold which would cause a drop of ink to be ejected. Alternatively, the print head is warmed by firing some droplets of ink into an external chamber or "spittoon," rather than onto the surface of the image receiving member.

European Patent Application 0 496 525 A1, the disclosure of which is incorporated herein by reference in its entirety, discloses ink jet recording method and apparatus in which ink is ejected by thermal energy produced by a heat generating element of a recording head. In the EP 525 application, driving circuits apply plural driving pulses to the heat generating element for every ink droplet ejected. The plural driving pulses include a first driving pulse used to increase a temperature of the ink adjacent the heater without creating a bubble, and a second driving pulse subsequent to the first driving pulse to eject the ink. Additionally, a width of the first driving pulse is adjustable to change an amount of ejected ink.

European Patent Application 0 505 154 A2, the disclosure of which is incorporated herein by reference in its entirety, discloses thermal ink jet recording method and apparatus which control an ink ejection quantity by changing driving pulses supplied to the recording head based on a variation in the temperature of the recording head. A preheat pulse is applied to the ink to control the ink temperature and is set to a value which does not cause an ink bubble to form. After a predetermined time interval, a main heat pulse is applied which forms an ink bubble to eject one or more droplets, such as a main droplet and satellite droplets, of ink from the ink channel.

U.S. Pat. No. 5,519,417 to Stephany, the disclosure of which is incorporated herein by reference in its entirety, discloses a power control system for a printer which has at least one heating element for producing spots. The system includes a thermostat, disposed on a print head, that senses the temperature of the print head. The sensed temperature is used to vary pulses applied to the at least one heating element to maintain a constant spot size.

Thus, it is known to advance the firing of a print ejector by applying different pulses to a print ejector, advancing the firing after applying a firing pulse.

U.S. Pat. No. 5,917,509 to Becerra et al., the disclosure of which is incorporated herein by reference in its entirety, discloses methods and apparatus for interleaving multiple pre-pulses in a thermal ink jet printer. The pre-pulses are timed to use the periods between preheating a print head to pre-warm additional print ejectors.

SUMMARY OF THE INVENTION

This invention provides methods and apparatus for using a print head having a plurality of drop ejectors.

This invention separately provides a thermal ink jet print head circuit architecture that enables arbitrary multiple prepulsing signals to be used.

This invention separately provides systems and methods for varying the timing of pre-pulses, as well as the timing of a final or firing pulse to sequentially pre-warm and fire print ejectors.

In various exemplary embodiments, each ejector has a heating element actuatable in response to input signals to emit a quantity of ink from the print head toward an image receiving member. Pulse trains comprising of a series of pulses are used as the input signals. The pulse train can be determined based on, for example, the temperature of the print head.

In various exemplary embodiments, the sequential and cumulative firings of the prepulses and final or drop-forming pulses in the selected channels throughout the print head are performed in a manner such that the switching transients due to energizing and de-energizing drop ejectors are reduced to the level of those due to one heater element turning on or off. The transients are reduced in spite of substantial variations in print head temperature, the number of print jets used and the print image produced. The image data is loaded from the printer controller into a print data array. The heating elements are then fired in a sequence controlled by pulse trains originating in a print head controller. The pulse trains are clocked to sequence the firing of the heating elements in a manner that minimizes the change in current per unit of time.

In various exemplary embodiments of this invention, using multiple pre-pulse wave forms allows drop mass to be stable over substantial temperature and pulse train ranges.

The print head circuit design accepts these arbitrary wave forms while decreasing switching noise, reducing fluidic cross-talk in the print head, and allowing maximal droplet ejection frequencies.

Other objects, advantages and features of the invention will become apparent from the following detailed description taken in conjunction with the attached drawings, which disclose exemplary embodiments of the invention.

BRIEF DESCRIPTION OF THE DRAWINGS

The invention will be described with reference to the following drawings in which like reference numerals refer to like elements and wherein:

FIG. 5 is a table showing a first exemplary embodiment of a pulse train table according to this invention;

FIG. 6 is a table showing a second exemplary embodiment of a pulse train table according to this invention;

DETAILED DESCRIPTION OF EXEMPLARY EMBODIMENTS

Figure 1:
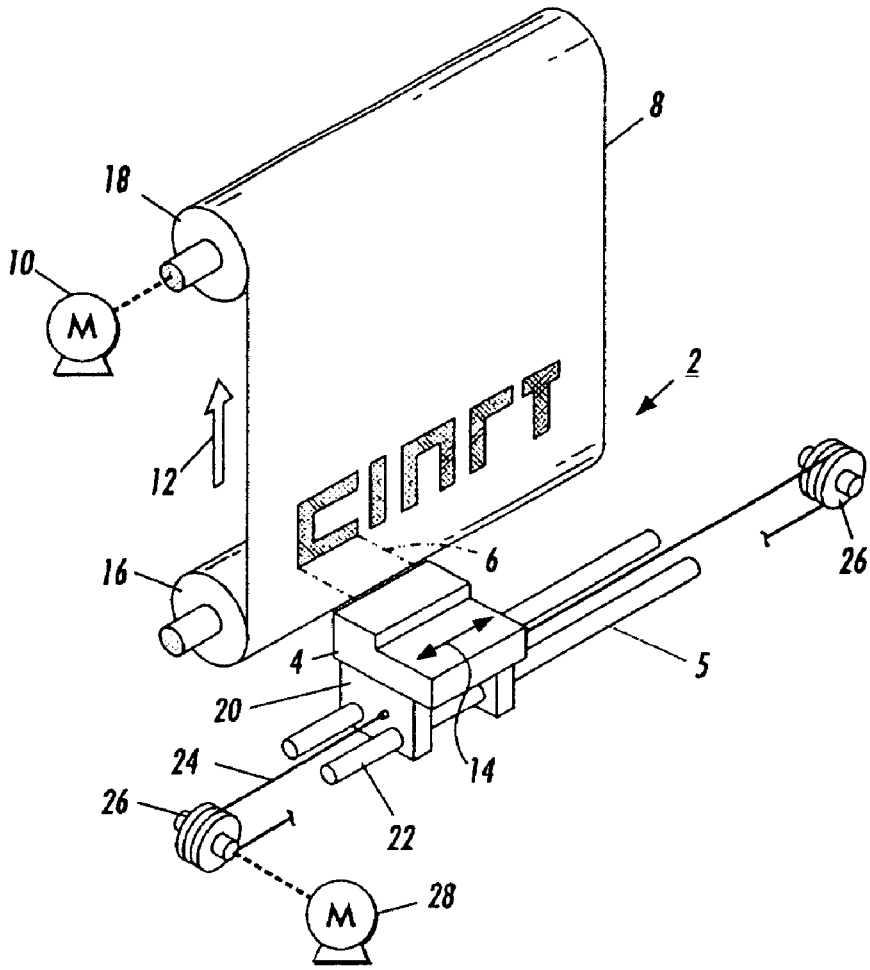
FIG. 1 is a schematic view of an ink jet printer.
Figure 2:
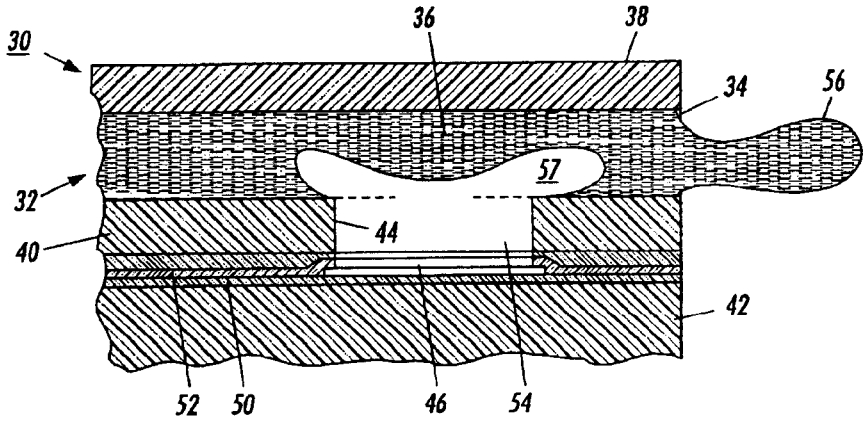
FIG. 2 is a crossview of a single ejector channel for a thermal ink jet print head.

For simplicity and clarification, the operating principles and design factors of various exemplary embodiments of the systems and methods according to this invention are explained with reference to one exemplary embodiment of a carriage-type ink jet printer 2, as shown in FIG. 1, and one exemplary embodiment of a printhead 30, as shown in FIG. 2. The basic explanation of the operation of the ink jet printer 2 and the printhead 30 is applicable for the understanding and design of any fluid ejection system that incorporates this invention. Although the systems and method of this invention are described in conjunction with the ink jet printer 2 and the printhead 30, the systems and methods according to this invention can be used with any other known or later-developed fluid ejection system.

FIG. 1 shows a carriage thermal ink jet printing device 2. A linear array of droplet producing channels is housed in a print head 4 mounted on a reciprocal carriage assembly 5. A number of ink droplets 6 are propelled towards a receiving medium 8, such as a sheet of paper, that is stepped by a motor 10 a preselected distance in a process direction, indicated by the arrow 12, each time the print head 4 traverses across the receiving medium 8 along the scan axis indicated by arrow 14. The receiving medium 8 can be stored on a supply roll 16 and stepped onto a take up roll 18 by the motor 10 or other means well known to those of skill in the art.

The print head 4 is fixedly mounted on the support base 20 of the carriage 5, which reciprocally moves along the two parallel guide rails 22. The print head 4 may be reciprocally moved by a cable 24 and a pair of pulleys 26, one of which is powered by a reversible motor 28. The print head 4 is generally moved across the receiving medium 8 perpendicularly to the direction that the receiving medium 8 is moved by the motor 10. Of course, any other known or later-developed structure usable to reciprocally move the carriage assembly 5 can be used in the thermal ink jet printing device 2.

Alternatively, the linear array of droplet producing channels may extend across the entire width of the receiving medium 8, as is well known to those of skill in the art. This is typically referred to as a fullarray. See, for example, U.S. Pat. No. 5,160,403 to Fisher et al. and U.S. Pat. No. 4,463,359 to Ayata et al., each of which is incorporated herein by reference in its entirety.

FIG. 2 shows one exemplary embodiment of an ink droplet emitter or ejector 30 of one embodiment of a typical ink jet print head 4. A plurality of such emitters 30 are found in a typical thermal ink jet print head 4. While FIG. 2 shows a side emitter, other emitters, such as roofemitters, may similarly be used with the systems, the methods and the architectures according to this invention. In an exemplary embodiment, the emitters 30 are sized and arranged in linear arrays of 300 to 600 of the emitters 30 per inch. Other dimensions can be used in other exemplary embodiments, as known to those skilled in the art.

A silicon member having a plurality of ink channels is known as a "die module" or "chip". Each die module can comprise hundreds of the emitters 30, spaced 300 or more to the inch. An exemplary full-width thermal ink jet print head may have one or more die modules forming a fullarray extending across the full width of the receiving medium on which the image is to be printed. In print heads with multiple die modules, each die module may include its own ink supply manifold, or multiple die modules may share a common ink supply manifold.

Each emitter 30 includes a capillary channel 32 terminating in an orifice or nozzle 34. The capillary channel 32 holds a quantity of fluid 36, such as ink, but not limited to ink, maintained within the capillary channel 32 until such time as a droplet of fluid is to be emitted. Each capillary channel 32 is connected to a supply of fluid from a fluid supply manifold (not shown). An upper substrate 38 is located adjacent to a thick film layer 44, which in turn is adjacent to a lower substrate 42.

Addressing electrodes 52 are sandwiched between the thick layer 44 and the lower substrate 42. The addressing electrodes 52 control and carry electrical current to one or more electrical heating elements 46 located within openings 54 in the thick film layer 44. Each of the ejectors 30 in the print head may have its own heating element 46 and individual addressing electrode 52. In various exemplary embodiments, the addressing electrode 52 may be protected by a passivation layer 40 and an insulating layer 50. Each addressing electrode 52 and associated heating element 46 may be selectively controlled by control circuitry, as will be explained in detail below, to form and grow vapor bubbles in the fluid 36 due to heating the fluid 36 in contact with the heater element 46, with droplets 56 of the ink being subsequently ejected from the print head 4. Other embodiments of the fluid print head are well known to those skilled in the art and are also within the scope of this invention.

When a signal is applied from a power source to the addressing electrode 52 using the control circuitry, the heating element 46 is energized. If the signal is of a sufficient magnitude and/or duration, the heat from the resistive heating element 46 will cause the fluid 36 immediately adjacent to the heating element 46 to vaporize, creating a bubble 57 of vaporized fluid. The force of the expanding bubble 57 ejects a fluid droplet 56, which includes a main droplet 56 and may include one or more smaller satellite drops from the orifice 34 onto the surface of the receiving medium. For a given heating pulse, or pulse train, length, the minimum voltage which causes a droplet of the fluid 36 to be ejected in response to the heating pulse or pulse train being applied to the heating element 46 is called the threshold voltage.

The thermal ink jet print head 4 may apply a plurality of pulses to the heating element 46 for each fluid droplet 56 to be ejected. One or more precursor pulses, i.e., warming pulses or prepulses, may be applied by the heating element 46 to warm the fluid 36 adjacent to the heating element 46. Subsequently, a print pulse, i.e., a drive pulse, a firing pulse or a main pulse, may be applied to the heating element 46. The print pulse causes the fluid droplet 56 to be ejected. The prepulses may be used to raise the temperature of the fluid 36 adjacent to the heating element 46 and additionally may be used to control the volume of the fluid droplet 56. The prepulses do not contain enough energy to cause the fluid droplet 56 to be emitted.

More particularly, in the thermal ink jet printing process according to this invention, a short duration voltage pulse may be applied to the heating element 46. This short duration voltage pulse very rapidly raises the temperature of the heating element 46, as well as the temperature of the fluid 36 that is in physical contact with the heater element 46. In the absence of an extant liquid/gas interface, the fluid 36 in the neighborhood of the heating element 46 may be superheated, i.e., heated beyond the normal boiling temperature of the fluid 36.

The vapor bubble 57 subsequently nucleates and grows at the surface of the heating element 46. The vapor bubble 57 begins to expand under the influence of the high initial vapor pressure, which can be, in various exemplary embodiments, several tens of atmospheres, and continues to expand due to inertial effects. As the size of the vapor bubble 57 grows, the pressure in the vapor bubble 57 decreases, due in part to the increase in the volume of the vapor bubble 57. However, the pressure in the vapor bubble 57 decreases as well due to cooling caused by the fluid 36 lying at the initially-expanding interface with the vapor bubble 57. This cooling occurs due to the fluid 36 evaporating at the bubble-fluid interface, as well as to heat conducting from the vapor bubble 57 into the surrounding fluid 36.

Following initial growth of the vapor bubble 57, the heating element 46 loses contact with the fluid 36. Accordingly, subsequent growth of the vapor bubble 57 is essentially unaffected by the temperature of the heating element 46. Thus, the eventual size of the vapor bubble 57, and thus the size of the droplet 56 of the fluid 36 ejected from the nozzle 34, depends on the energy stored in the layer of superheated fluid 36 which was in contact with the heating element 46 when the vapor bubble 57 nucleated. With higher print head and ink temperatures, there is more energy stored in the superheated fluid 36 next to the heater element 46 when the ink temperature reaches the nucleation value.

In addition, the viscosity of the fluid depends on the temperature of the fluid. In particular, higher fluid temperatures lead to lower viscosity, and similarly reduced resistance to flow. Thus, high temperatures cause more energy to be stored in the superheated layer in the fluid 36, and cause lower resistance to the impulsive flow involved in ejecting the fluid droplets 56. As a result, drop volumes increase with print head temperature.

In addition, only a small fraction of the energy dissipated in the heater element 46 is utilized in nucleating the vapor bubble 57 and producing the fluid droplet 56. The remainder of the heat flows into the die and subsequently into a heat sink, raising their temperature. Thus, continued use of the thermal inkjet print head causes the temperature of the thermal inkjet print head to increase. Unless some device, structure or apparatus is provided to prevent drop masses from changing, drop masses will increase with continued use of the thermal inkjet print head, thus degrading print quality. In addition, thermal inkjet print heads may be used within a range of ambient temperatures. Variations in the ambient temperature may exacerbate the variations in droplet masses due to the self-heating effect described above.

Simply changing pulse width or voltage in response to changes in print head temperature is a relatively ineffective method of maintaining a constant drop volume as the temperature of the thermal inkjet print head changes. This occurs due to the de-coupling of the heater element 46 from the fluid 36 by the vapor bubble 57 once the vapor bubble 57 forms and due to the requirement for a minimal or threshold voltage below which no droplet 56 is produced.

The energy input to the heating element 46 can be varied to provide different energy amounts stored in the layer of superheated fluid 36 at the time of vapor bubble nucleation, by breaking the heating pulses into two or more segments. Following this technique, energy is supplied to the heater element 46 and the fluid 36 via one or more pre-pulses which locally heat the fluid 36. In various exemplary embodiments, the fluid 36 is heated to temperatures above the normal boiling point of the fluid 36, to provide some superheat in the fluid 36, but not to the temperature required for a vapor bubble 57 to form and grow. With the fluid 36 next to the heater element 46 thus pre-heated, a relatively short off, or soak, time allows the heat to diffuse deeper into the fluid 36, while the temperature of the fluid 36 next to the heater decreases. A subsequent main or firing pulse, possibly having a longer duration, is then provided to the heater element 46 to re-heat the fluid 36 next to the heater element 46 to the nucleation temperature, where a vapor bubble 57 forms, causing a droplet 56 of the fluid 36 to be ejected.

Figure 3:
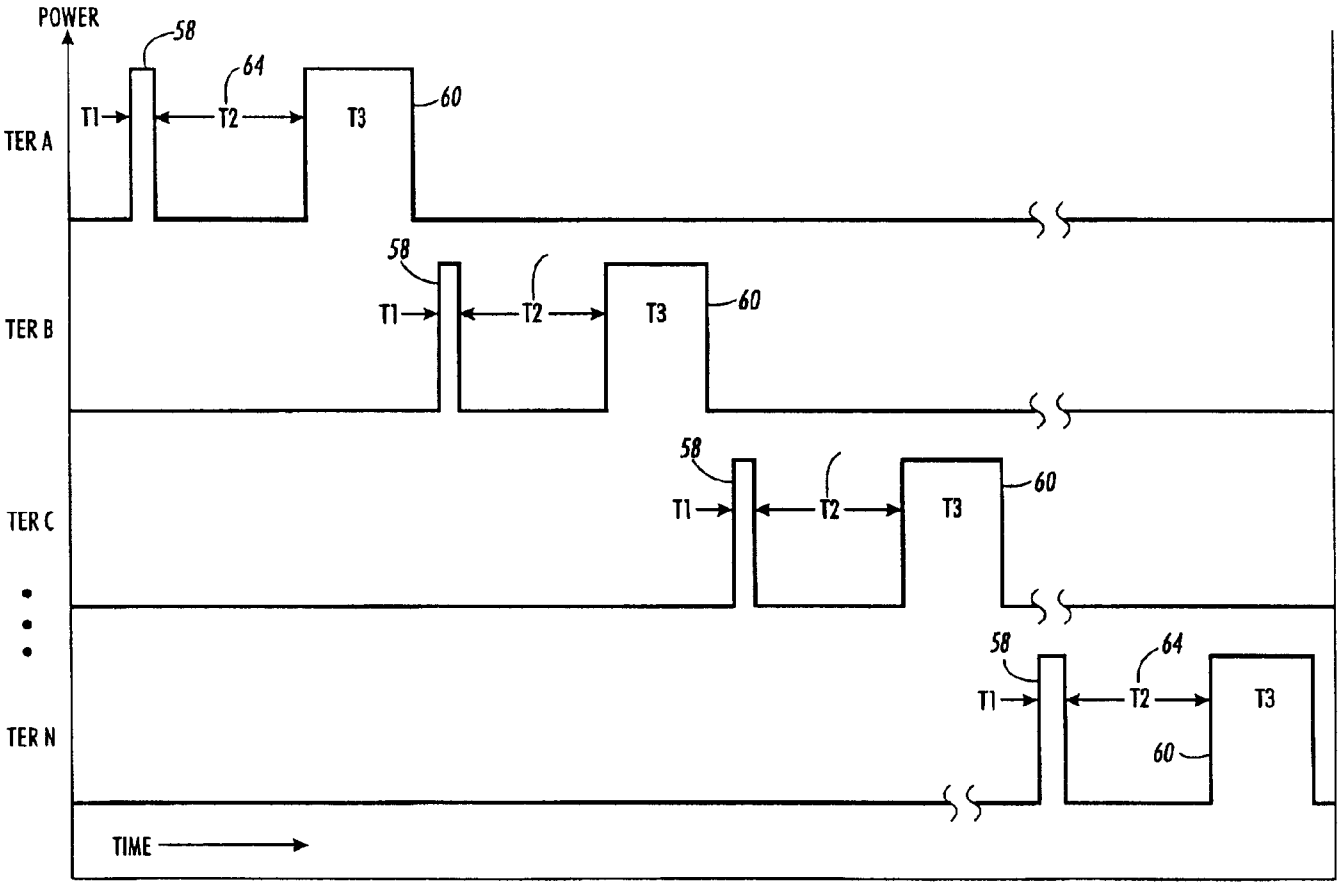
FIG. 3 (Related Art)
FIG. 3 is a conventional timing diagram showing how single prepulses may be applied in a printing device to banks of emitters.

FIG. 3 is a timing diagram showing how conventional prepulse and firing signals are applied to the emitters 30 or banks of the emitters 30, in a thermal inkjet print head. A precursor pulse 58, having a duration T1, is applied to an emitter, or an emitter bank, A, to warm the fluid 36 and/or to control a size of the fluid droplet 56 to be ejected. This is followed by a relaxation time interval 64 having a duration T2. Then, a print pulse 60 having a duration T3 is applied to a specific emitter or the emitter bank A. Subsequently, a second precursor pulse 58 followed by a second relaxation time interval 64 and a print pulse 60 are applied to an emitter, or an emitter bank, B. This process continues across the print head in serial fashion until all the emitters 30, or all of the emitter banks, required to eject drops of fluid have been addressed.

Figure 4:
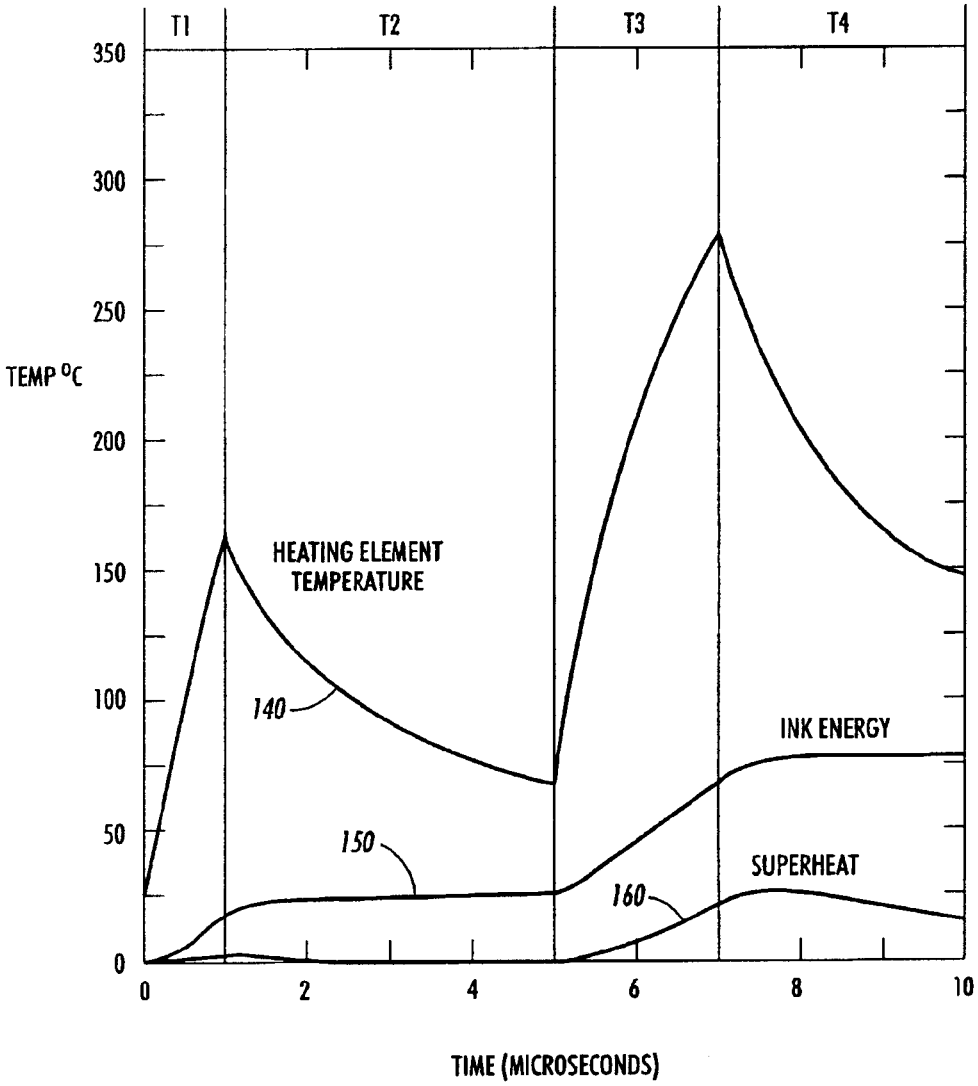
FIG. 4 (Related Art)
FIG. 4 is the temperature history at the inkelement interface for a single prepulse in a conventionally driven thermal ink jet printhead.

FIG. 4 shows a typical temperature vs. time evolution curve 140 for the fluid 36 next to the heater element 46 of a print head driven by the single-pre-pulse waveform shown in FIG. 3. FIG. 4 also shows corresponding plots of the energy 150 delivered to the fluid 36, and the amount of energy 160 stored in the layer of superheated fluid 36. The superheat energy is that energy stored in the layers of the fluid 36 having temperatures above the normal boiling point for the fluid 36. For the water-based inks used in a thermal ink jet, the normal boiling point of the fluid is slightly over 100° C.

By using the pre-pulse 58 and the delay interval 64 prior to the application of the main or firing pulse 60, the local temperature, i.e., the temperatures of the heater element 46 and of the fluid 36 within a few micrometers of the heater element 46, as well as the energy stored in the superheated fluid 36 at nucleation, are similar to those temperatures for the same print head at an elevated temperature. Therefore, utilizing a pre-pulse makes the drop volume increase relative to that for the same print head with a single drop-ejecting pulse.

By varying the durations of the pre-pulses 58 at a constant operating temperature, the drop volume can be changed, where longer pre-pulses 58 result in larger drop volumes. Alternatively, by varying the durations of the pre-pulses 58 in response to changes in print head temperature, the drop volume may be held constant as the print head temperature changes. With suitable adjustments to the durations of the pre-pulse 58 as well as to the main pulse 60 in response to changes in print head temperature, the drop volumes as well as the operating point for the print head, relative to the threshold voltage, may be held constant in spite of the changes in temperature.

There are limitations to the amount of control over drop volume that can be achieved by using a single pre-pulse 58 if the operating voltage of the print head is to be fixed. One such limitation is due to the onset of interference. Interference occurs when the pre-pulse duration is so long that small, localized vapor bubbles 57 form on the heater element 46 near the end of the pre-pulse 58. These vapor bubbles 57 may fail to grow sufficiently to eject a droplet 56 by themselves. However, the presence of these small localized vapor bubbles 57 disturbs the desired uniform pre-heated layer of fluid 36 next to the heater element 46. Additionally, any residual vapor bubbles 57 on the surface of the heater element 46, when the main pulse has heated the fluid 36 to the nucleation temperature, may adversely affect the desired subsequent explosive growth of a drop-ejecting vapor bubble 57. In practical terms, for a single pre-pulse drive waveform, drop volume increases with pre-pulse duration, but the duration of the single pre-pulse 58 is limited by the onset of interference. When used in a drop volume stabilization scheme as described above, drop volumes may be held constant over a temperature range of about 15° C. by using a single pre-pulse 58, when constrained by the effects of interference as well as the additional requirement that the threshold voltage remain constant.

The advantages of a multiple prepulse waveform according to this invention, relative to a single prepulse waveform, arise because the relatively low average power level resulting from using a relatively large number of short, appropriately-spaced pre-pulses allows a thicker layer of fluid 36 to be pre-heated, which provides a higher level of superheat energy in the fluid 36 at the time of the explosive growth of the vapor bubble 57 when the firing pulse 60 is applied to the heater element 46. This increase in the superheat energy available to drive the growth of the vapor bubble 57 and the drop ejection is achieved with the multiple pre-pulse waveform according to this invention without the damaging effects of interference by pre-heating a thicker layer of the fluid 36 to a lower peak temperature than would be obtainable if a single pre-pulse wave form were used to achieve the same superheat energy.

Because the probability that interference bubbles will form depends on the peak fluid temperature during the pre-heating process, the lower peak temperature due to the multiple pre-pulse wave form according to this invention allows greater energy to be stored into the fluid 36 without forming interference vapor bubbles 57. The ability of the multiple pre-pulse waveforms, according to this invention, to achieve greater superheat energy levels without the deleterious effects of interference enables a larger range of temperatures over which the drop volumes may be held constant by varying the number of pre-pulses in the multiple pre-pulse pulse train.

The multiple prepulse waveforms according to this invention limit the temperature rise in the fluid 36 with each prepulse 58 by utilizing short heating pulses as the prepulses 58. Intervals between these short prepulses 58 allow the heat to diffuse into the fluid 36 somewhat before a next heating prepulse 58 or main pulse 60 is applied. This is approximately equivalent to preheating the fluid 36 with a long duration, but low power-density, heating prepulse 58.

However, it should be appreciated that it is important to drive the fluid temperature through the nucleation level briskly and continuously. Thus, an exemplary multiple prepulse waveform according to this invention has a relatively large number of short prepulses 58, and a relatively long main pulse 60 at the end of the pulse train. The relatively long main pulse 60 assures that the fluid temperature is taken briskly and continuously through the nucleation temperature during the relatively long main pulse 60 in spite of variations in circuit parameters.

The multiple prepulsing methods according to this invention substantially increase the temperature range over which the drop volume can be controlled. It has been determined that the superheat content of the fluid 36 plays an important role in determining the droplet volume. The superheat content of the fluid 36 changes either because of prepulsing, because the die temperature rises due to heat build-up in the die, or because of a combination of both factors. Even though the superheat may be the same under different combinations, the droplet volume will depend upon how that superheat is accumulated.

At a given die temperature, the droplet volume can be increased by increasing the superheat using different pulsing patterns. In various exemplary embodiments according to this invention, a larger number of prepulses 58 is used to drive the print head when the print head is at its lowest temperature. The number of prepulses 58 decreases as the temperature of the print head increases to hold the drop volumes constant. In practice, a schedule of pulse trains can be used over different ranges of temperatures, such that the drop volumes and threshold voltages are maintained essentially constant in spite of the changes in the temperature of the print head.

FIGS. 5 and 6 show two exemplary pulse and interval signal profile tables usable to keep the exemplary print emitter"s drop volume constant over a range of temperatures while maintaining threshold voltages relatively constant according to this invention. The tables in FIGS. 5 and 6 show pulse and interval times in microseconds ($\mu$s), with the main pulses given subscripts of zero, and preceding prepulses and intervals identified with successively larger subscripts. For example, as shown in the profile table shown in FIG. 5, when the temperature of the print head is 30 degrees C., an initial prepulse $P_5$ lasts for 0.3 microseconds. A second prepulse $P_4$ then lasts for 0.3 microseconds after a first 0.6 microsecond interval $S_5$. A third prepulse $P_3$ then lasts for 0.3 microseconds after a second 0.6 microsecond delay $S_4$. A fourth prepulse $P_2$ then lasts for 0.2 microseconds after a third 0.6 microsecond interval $S_3$. A fifth or final prepulse $P_1$ then lasts 0.2 microseconds after a fourth 0.6 microsecond interval $S_2$. A main pulse $P_0$ then lasts 2.0 microseconds after a fifth or final interval $S_1$ that lasts for 0.6 microseconds. Means for measuring or estimating the temperature of the printhead are provided so that the printhead controller can select which pulse train to utilize for a given printing area.

While calculations indicate that pulse-train schedules incorporating initial pre-pulse segments with longer pulse duration and relatively shorter intervals between pulses should provide even larger temperature control ranges, experiments have shown those to result in relatively unstable droplet velocities, apparently due to interference-like phenomena.

One potential disadvantage of using longer pulse trains for the multiple pre-pulse trains disclosed above is that the time required to apply the full pulse train to the heater elements 46 increases. To enable an adequate electrical operating frequency limit for a print head utilizing a multiple pre-pulse wave form according to this invention, larger numbers of heater elements 46 need to be on at any single time if the total time for moving the pulse train through the print head should remain below a threshold time. This has implications for electrical transients due to simultaneously switching the currents to all the heater elements 46 that are addressed at the same time, and for the fluidic transients resulting from simultaneously forming and growing large numbers of the vapor bubbles 57. In addition, the relatively complex and variable nature of the pulse trains prevents using known print head circuit architectures. In various exemplary embodiments, a print head circuit architecture according to this invention that avoids these performance-limiting factors allows the multiple pre-pulse wave forms according to this invention to be effectively utilized.

Figure 7:
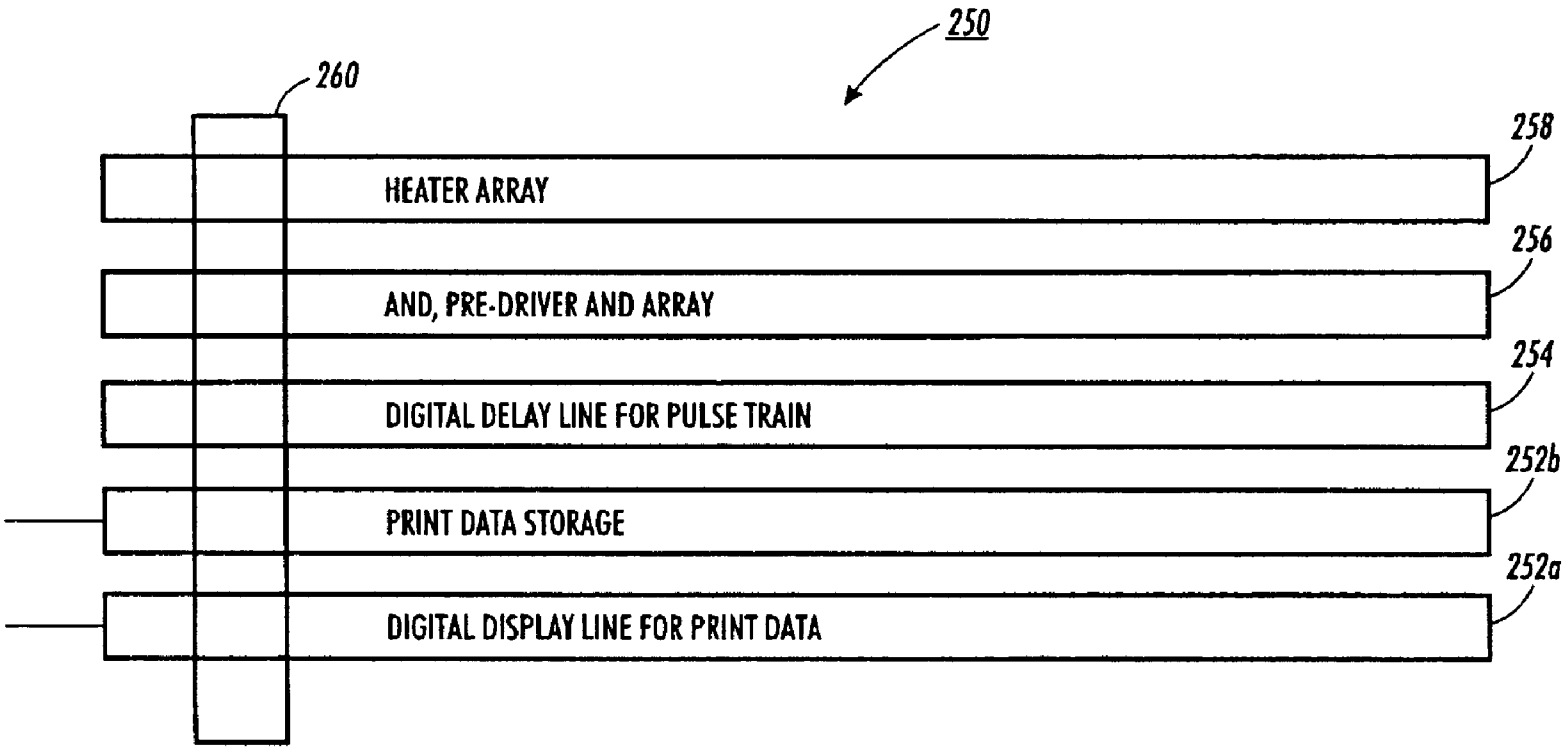
FIG. 7 is a block diagram of one exemplary embodiment of an ink jet emitter driver circuit according to this invention.

FIG. 7 is a schematic diagram of one exemplary embodiment of a circuit 250 according to this invention usable to control a thermal ink jet emitter array that avoids these performance limiting defects. The circuit 250 includes a digital delay line 252*a* to allow serial loading of print data, a print data storage array 252*b*, a digital delay line for the pulse train 254, an array of AND gates, pre-drivers and drivers 256, and an array of heater elements 258. One element in each of the arrays 252, 254, 256 and 258 is associated together into a slice, such as slice 260.

Print data from a printer controller, such as a computer, a network or a copier, is input to the print data storage array 252. In an exemplary embodiment, the data bits are serially shifted into the digital delay line 252*a*, and then simultaneously latched into the print data storage array 252*b*. The print data delay line 252*a* can be implemented as an array of D-type flip-flop circuits, or any other known or later-developed circuitry usable to latch and propagate the print data down the print data delay line 252*a*. In various exemplary embodiments, the print data storage array 252*b* stores the print data for a predetermined time period. Alternately, in various exemplary embodiments, the print data delay line 252*a* simply forwards appropriate information to the array 256 of AND gates, pre-drivers and drivers.

The contents of print data storage array 252*b* determine whether the associated ink jet emitters are to be fired in a particular stroke. If the print data bit is set for a particular slice 260, the print data storage array 252*b* forwards a positive signal to the AND gate of the array 256 of AND gates associated with the slice 260.

The digital delay line for the pulse train 254 receives a serial pulse train from the print head controller and shifts it down the array in accordance with a clock signal. The contents of each cell of the digital delay line for the pulse train are also provided to the associated elements of the array of AND gates 256.

The array 256 of AND gates combines the print data signals from print data storage array 252*b* and the pulse train on the digital delay line 254. When both signals are positive for a particular slice 260, the AND gate of the array 256 of heater elements associated with that slice 260 forwards a positive signal to the heater element of that slice 260 of the array 258. The heater element of the array 258 then heats the ink using current I.

Figure 8:
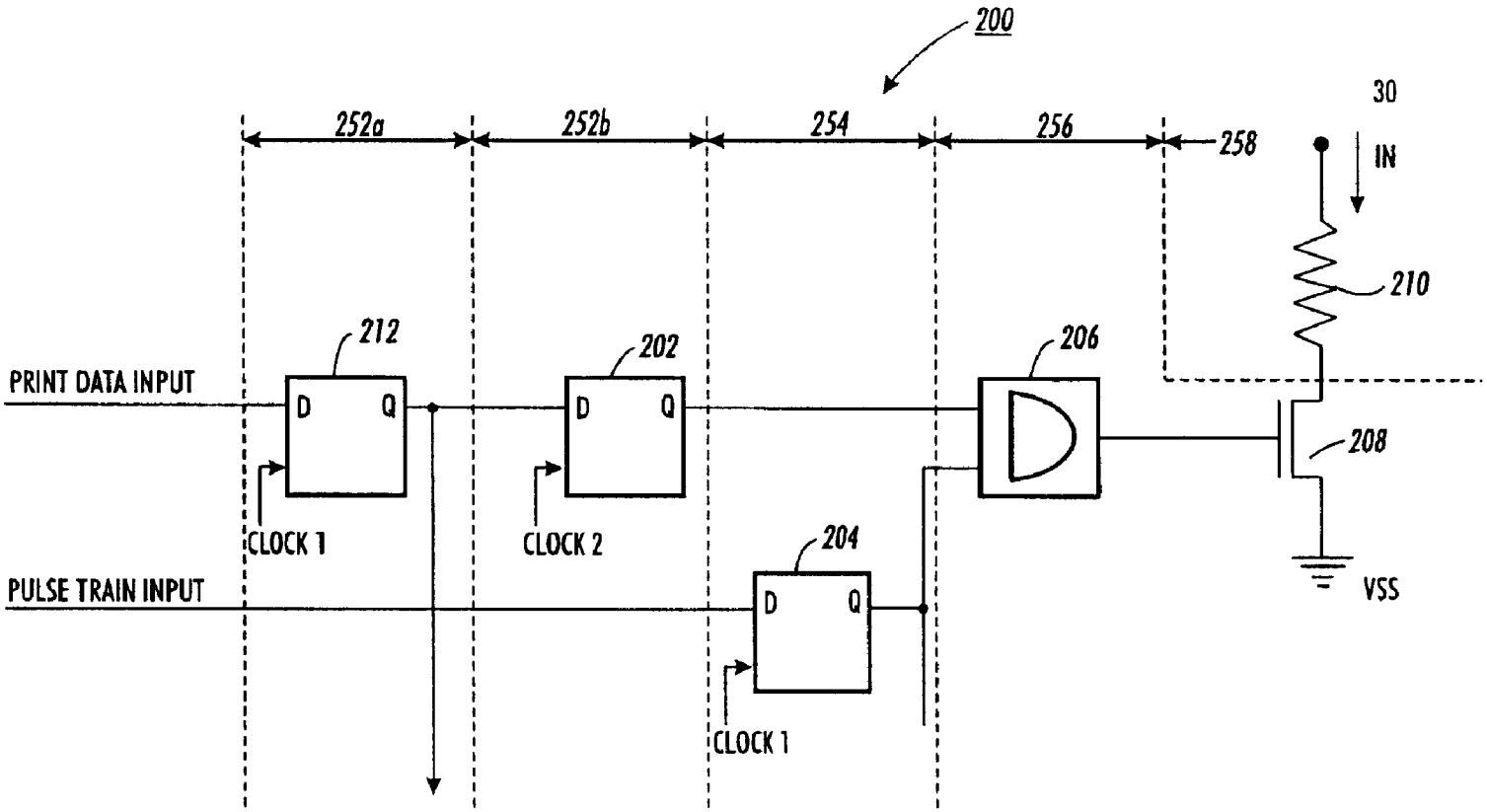
FIG. 8 is a block diagram of one exemplary embodiment of an ink jet emitter driver circuit according to this invention usable as a slice of the driver circuit of FIG. 7.

FIG. 8 is a schematic diagram of one exemplary embodiment of a device circuit 200 used to implement a slice 260, and that, individually, can be used to control an individual thermal emitter 30. The drive circuit 200 includes a heater resistor 210, a driver or power transistor 208, a number of D-type flip-flop circuits 202, 204 and 212, and an AND gate 206.

Each slice 260 can include a latch 212 that is one element of a chain of latches forming a serial data register implementing the print data delay array 252*a*. This register loads and stores the print data. The input of each latch "n" takes data from the previous serial data latch "n−1" and sends it to the next latch "n+1." The output of the Nth latch is also fed forward to another latch 202 which forms one element of a large parallel data register, used to implement the print data storage array 252*b* with $N_T$ stages. The collection of all serial data latches in 252*a* forms a serial data register with $N_T$ stages with one primary data input to the thermal print head.

The set of latches which comprise the parallel data register, or print data storage 252*b*, can store the data to be printed while new data is simultaneously loaded into the serial data register 252*a*. The output of latch 202 is connected to the input of the logical AND circuit 206.

A latch may also be used as an element of a chain of latches forming the pulse train digital delay line 254. This register stores the pulse train to be used to energize the heater 210 shown in FIG. 8. Latch 204 takes its input from the pulse train latch of the previous stage n−1 and sends it to the next stage n+1. The output of the nth stage is also connected to the input of the logical AND circuit 206. The collection of all pulse train delay latches can form a digital delay line 254 with N stages, and with one primary pulse train input to the thermal ink jet circuit.

The print data from a printer controller, such as a computer, a network or a copier, is loaded into the D-type flip-flop circuit 212, along with a clock signal from a first clock signal CLOCK 1. The D-type flip-flop circuit 212 stores the print data for a predetermined time period. The D-type flip-flop circuit 212 acts in concert with the neighboring D-type flip-flop circuit 212 of the next slice along the circuit 250. The D-type flip-flop circuits 212 form a long shift register which is loaded with the data in a series fashion.

Once all the data is loaded into the D-type flip-flop circuits 212 in each slice of circuit 250, the D-type flip-flop circuits 202 are clocked by a second clock signal CLOCK 2, which loads all of the data stored in the D-type flip-flop circuits 212 into the array of D-type flip-flop circuits 202. The D-type flip-flop circuits 202 then retain this print data and present it to the AND gate 206.

The D-type flip-flop circuit 204 in slice 260 is loaded with a bit from the pulse train which is supplied by the print head controller to the D-type flip-flop circuit 204 in the first slice of the circuit 250, and shifted into the corresponding circuit 204 of slice 260 from the previous slice with the timing controlled by the clock signal CLOCK 1. The pulse train will typically include a series of prepulses and a main pulse. In accordance with the timing of the CLOCK 1 signal, the D-type flip flop circuit 204 then forwards its bit from the pulse train to the AND gate 206 and to the corresponding D-type flip-flop circuit 204 of the next slice.

The separate first and second clock signals CLOCK 1 and CLOCK 2 allow a next set of data to be loaded into the D-type flip-flop circuit 212 while the data stored in the D-type flip-flop circuit 202 is utilized for a current firing stroke. Thus, the circuits according to this invention can load data into the D-type flip-flop circuit 212 timed by Clock 1, while simultaneously pulsing the data from the D-type flip-flop circuit 204. This above described procedure continues until there is no more data and no more clocks. At this point the carriage has completed its scan across the paper, and it will then be reinitialized for the next pass.

The AND gate 206 combines the signals from the D-type flip-flop circuits 202 and 204. When both signals are positive, the AND gate 206 forwards a drive signal to driver or power transistor 208. The driver or power transistor 208 allows the current $I_n$ to flow through the heater resistor 210 in response to the drive signal. As a result the heater resistor 210 resistively heats.

A heater element of the heater array 258 in a particular slice 260 is energized when the data input and the pulse train are both active for that slice 260. It should be noted that if the data bit corresponding to slice 260 is set, the heater power in that slice will vary from clock cycle to clock cycle in accordance with the sequence of pulses in the pulse train as the pulse train is shifted through slice 260.

It is obvious to anyone skilled in the art that the printhead circuit architecture as described above allows the pulse train to be any complex sequence of pulses and intervals. Therefore, for a pulse train of P "time slots", it is possible to provide $2^P$ unique heating profiles of temperature versus time. This approach allows the heating profiles to be flexible and extend the range of possible power versus time profiles and temperature versus time profiles. In contrast, analog techniques enabling similar power and temperature profiles would be expensive and complex to implement on the thermal print head.

In various exemplary embodiments, the pulse train schedules shown in FIGS. 5 and 6 are usable in the systems, methods and circuit architectures according to this invention to make the size of the ink drops emitted by the thermal ink jet emitters 30 more constant. It can be seen that within the pulse train schedules shown in FIGS. 5 and 6, there are variations in number and length of prepulses, length of the main pulse, and overall length of the pulse train. Alternatively, the pulse trains shown in FIGS. 5 and 6 can be used in various exemplary embodiments of the systems methods and circuit architectures according to this invention to controllably vary the size of the ink drops emitted by the thermal inkjet emitters 30 in selected ways.

It is likewise obvious to anyone skilled in the art that the printhead circuit architecture described above reduces the instantaneous variations in total current flow to the heaters in the printhead to a value equal to that of the current flow to a single heater element. This minimized current transient results from the bit-by-bit insertion and advancement of the pulse train into and through the serial shift register formed by the D-type flip-flops 204 in each of the slices 260 in the printhead. The overall current flow to the heaters in the printhead—subject of course to the previously loaded and latched data bits—thus incrementally increases as the pulse train enters delay line 254 and incrementally decreases as the pulse train leaves delay line 254.

Figure 9:
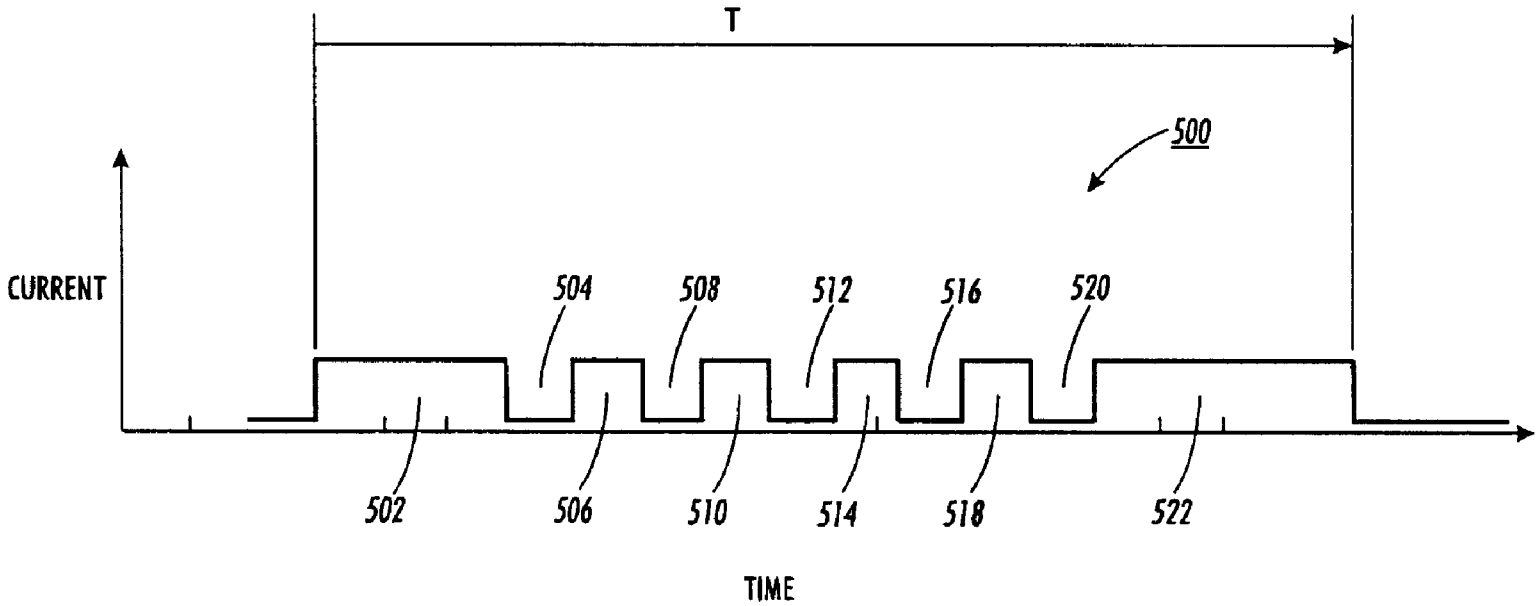
FIG. 9 shows a first exemplary embodiment of a pulse train according to this invention.

FIG. 9 shows a time plot of an exemplary multiple-pre-pulse pulse train which has five pre-pulses followed by a main pulse. If the tic-marks on the abscissa indicate 0.5 $\mu$sec intervals, we see that the first pre-pulse 502 is 1.5 $\mu$sec long, whereas all succeeding pre-pulses (506, 510, 514 & 518) are 0.5 $\mu$sec long. We see further that intervals 504, 508, 512, 516 & 520 are 0.5 $\mu$sec, and that the main pulse 522 is 2.0 $\mu$sec. The overall length of the pulse train T is simply the sum of all the on and off times: 8 $\mu$sec.

Figure 10:
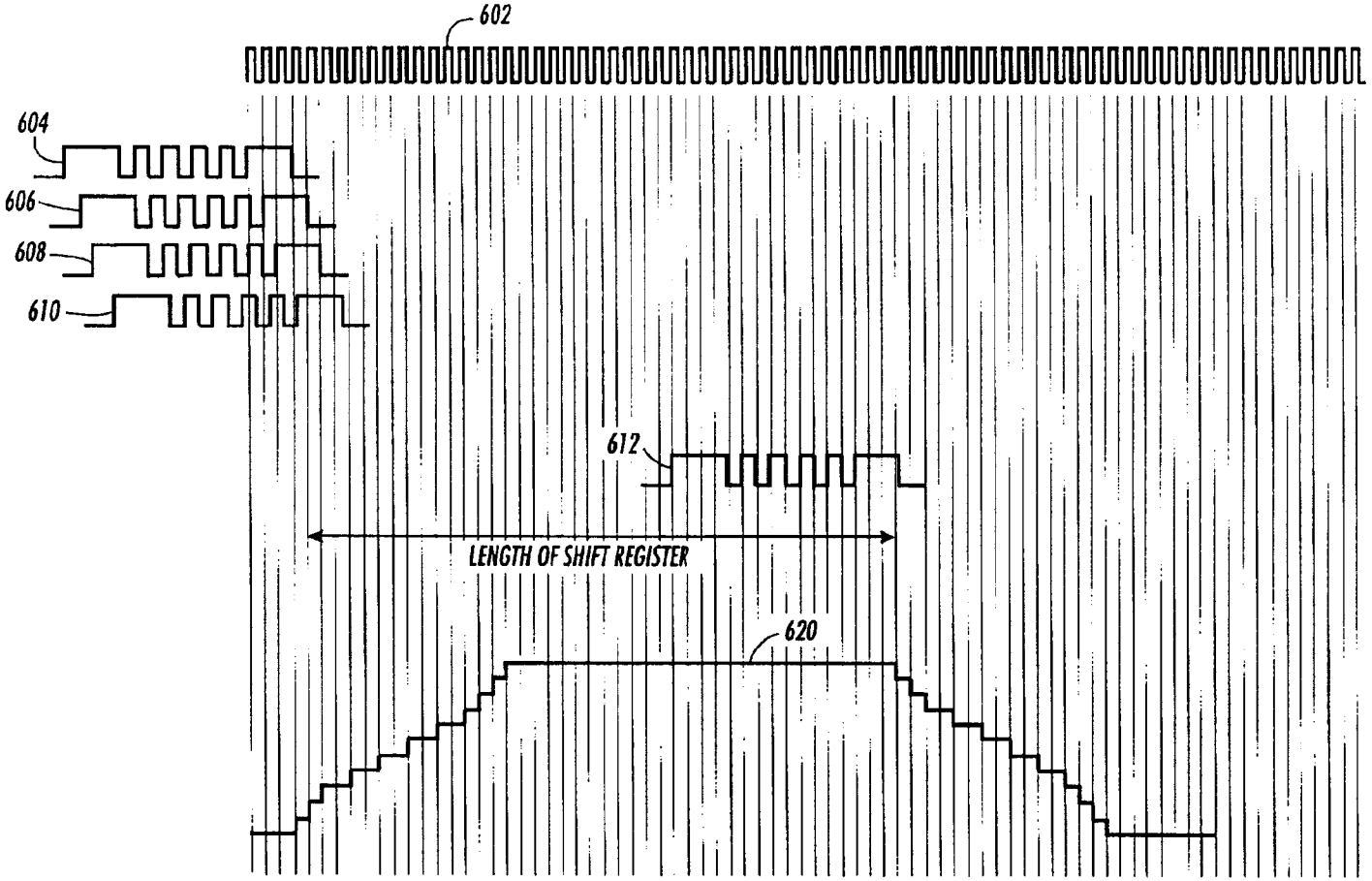
FIG. 10 shows one exemplary embodiment of a pulse train moving through a print head and the associated current according to this invention.

FIG. 10 shows a combined graph of one embodiment of the circuit architecture performing the multiple prepulse method according to the present invention and the total heater current at each instant in time during the passage of the pulse train through the printhead. The exemplary printhead circuit has an effective length as indicated by the arrow on FIG. 10. The input signal is the pulse train shown in FIG. 9, composed of desired pre-pulse and main pulse signals, and shown here at various locations 604–610 on the timing diagram. Clock 602 controls the advancement of the pulse train through the pulse train shift register or delay line. For the purposes of this example, we assume that the data has been pre-loaded, and that that data calls for each channel in the exemplary printhead to fire a droplet of ink. The pulse train is supplied to the printhead"s pulse train shift register or delay line, and at the instant indicated by the location of pulse train 604, the lead edge of the first pre-pulse is just about to enter the first stage of the pulse train shift register. One clock period later, the pulse train is as indicated by number 606, and the overall heater current waveform 620 shows an incremental increase in current. Following a second clock pulse, the pulse train is at the location indicated as 608, and we see that at that time, the heater current has incremented again. With each period of the clock, the pulse train advances into and through the pulse train shift register, and the heaters corresponding to each of the slices in the head in which the pulse train bit is high are activated. In FIG. 10, the overall heater current (the sum of the currents flowing through all the heaters) increases in a step-wise manner in response to each clock pulse so long as the incoming pulse train bit is set. After the full pulse train has been shifted into the printhead"s pulse train shift register, and until the first pre-pulse begins to be shifted out of the shift register, the overall heater current is constant. Finally, at a time indicated by the location of pulse train 612, the pulse train begins to be incrementally shifted out of the printhead shift register, and the overall current decreases in increments of the current that flows through a single heater.

In the exemplary embodiment shown in FIGS. 7 and 8, the digital delay array 254 uses one digital delay element for each slice, where each slice 260 contains one heater element. In the exemplary embodiments shown in FIGS. 7 and 8, the digital delay line delays the pulse train data from the printer controller by a time interval "t" in each slice 260. This time interval "t" is determined by the period of the clock signal input to the delay elements of the digital delay array 254. Accordingly, power is switched to the enabled heaters synchronously in each time slot having this same duration "t". In various exemplary embodiments, the exemplary input multiple prepulse waveform has a duration of K*t. That is, the multiple prepulse waveform applied to each slice 260 extends over K time slots. In such a multiple prepulse waveform, the total time required to select all of the N heaters shown in FIG. 7 is (K+N)*t. In contrast, in a sequential circuit that applies the multiple pre-pulse waveform sequentially and serially to each individual heater element, the total time to select all N heater elements 46 is K*t*N which, for practical values of K and N is greater than (K+N)*t. Therefore, the circuit architecture shown in FIGS. 7 and 8 is faster than serial sequential circuits, and the shorter cycle time enabled by the improved circuit architecture allows the printhead to fire droplets at higher operating frequencies.

Of course, it would be apparent to one skilled in the art that the speed of an architecture using serial sequential addressing can be improved, for example, by addressing groups or banks of heaters 46 simultaneously. For example, by associating and simultaneously activating groups or banks containing P heater elements each, the total selection time would be reduced to K*t*N/P for the conventional serial-sequential architecture. However, the simultaneous application of power to banks of P heater elements 46 requires switching P times as much current I at a given time. A 320-jet printhead with the circuit architecture as shown in FIGS. 7 and 8 would require 48 $\mu$sec to address all the heaters with a 64-bit pulse train and a 8 MHz clock frequency. In order to achieve the same cycle time with the same pulse train, the serial-sequential circuit would need to address groups or banks containing 53 heaters each.

As is well known in the art, abrupt changes in current can cause voltage spikes in the power supply connection $V_{SS}$, based on the conductance in the circuit. This voltage spike is undesirable, and as well known, can reduce the reliability of the print head circuit architecture. In general, relative to a bank-fired serial-sequential circuit architecture that provides current to P different heater elements 46, the circuit architecture shown in FIGS. 7 and 8 will have a switching noise amplitude only 1/P as large. Thus, the print head circuit architecture shown in FIGS. 7 and 8 significantly reduces the electrical switching noise as the heaters are energized and de-energized relative to conventional circuit designs with the same or similar cycle times.

In general, due to fluidic cross-talk between the capillary channels associated with adjacent slices 260, it is generally desirable to increase the temporal difference in firing times for physically adjacent slices 260. The print head circuit architecture shown in FIGS. 7 and 8 can be designed to allow specific slices 260 to be enabled in a given pass through the printhead. Thus, it is not necessary to address all adjacent slices in the same pass, although if all are not addressed in each pass, multiple passes must be made to address all the slices. Because non-adjacent slices 260 can be energized in a single pass, the distance between the near-simultaneously energized heaters can be increased. This tends to reduce the instantaneous fluid flow at any point in the fluid supply circuit that supplies fluid to the heater elements 46, and it also tends to reduce the heater current density in the print head circuit leads and other circuit elements in the print head.

The temporal difference between the firing times of physically adjacent slices 260 can be increased by appropriately arranging the digital delay for pulse train 254 in multiple segments and providing the appropriate interconnectections within the printhead. In this way, the physical spacing between simultaneously active slices is controlled. For example, an embodiment of the circuit architecture 250 shown in FIGS. 7 and 8 operates particularly well when the active slices 260 are physically separated by three inactive slices 260, so that all the slices 260 in the circuit architecture 250 shown in FIGS. 7 and 8 can be addressed in four distinct passes or ripples.

Figure 11:
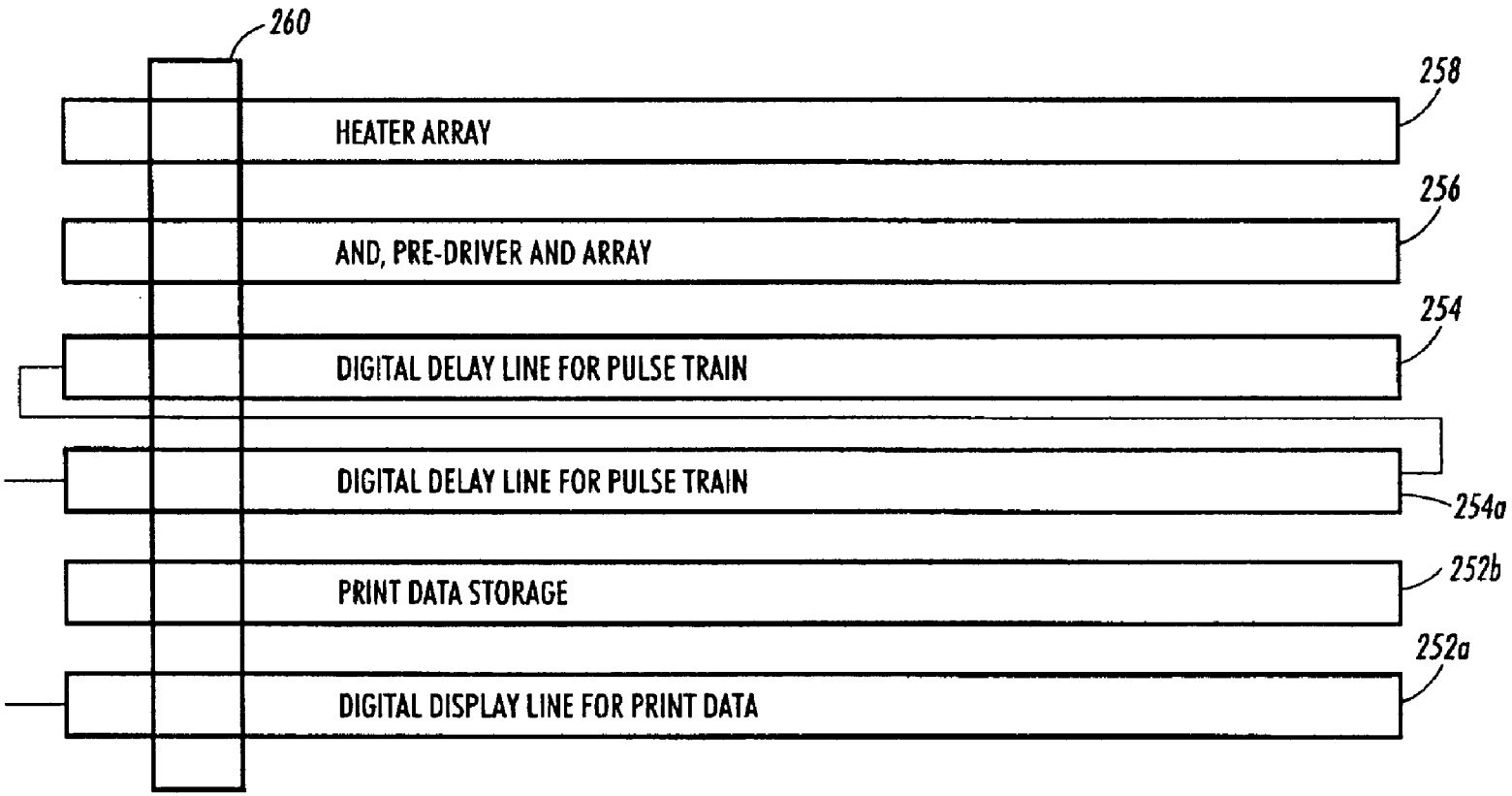
FIG. 11 is a block diagram of a second exemplary embodiment of an ink jet emitter driver circuit according to this invention.

In this way, each ripple addresses one-fourth of the total number of slices 260 in the circuit architecture 250 shown in FIGS. 7 and 8. Therefore after four passes or ripples, each of the slices 260 will have been addressed and the cycle can begin again. Thus, in various other exemplary embodiments, the circuit architecture 250 shown in FIG. 7 can have, instead of the single delay line array 254, a connected pair of digital delay line arrays positioned along the heater array as shown in FIG. 11. FIG. 11 shows an architecture in which the digital delay line for pulse train 254 is broken into two half-length sections 254*a* and 254*b*, wherein the pulse train from the controller is fed to the cell at one end of 254*a* and the output from the last cell of 254*a* is fed to the first cell of 254*b*. As was the case in FIG. 7, in FIG. 11 the print data is supplied by the controller to the digital delay line for print data 252*a*, and the print data bits are latched into the print data storage elements 252*b*. A preferred 320-jet, 4-ripple printhead architecture of the current type has a 160-bit digital delay line for print data 252*a*, a 160-bit latch array for the print data 252*b*, two connected 80-bit digital delay lines for pulse train 254*a* & 254*b*, a heater array 258 with 320 heaters, and an AND circuit, a pre-driver and a driver for each heater. The outputs of the delay elements of the digital delay line for the pulse train 254*a* & 254*b* are then connected as inputs to the corresponding elements in the AND array 256, as are the outputs of the print data storage latch 252*b*. An internally-generated but pre-settable odd/even signal provides a third input to each of the AND gates, while the outputs of the AND gates provide the drive signals to the pre-drivers and drivers 208.

The preferred architecture"s physically-folded, 160-bit digital delay line for the pulse train 254*a* & 254*b* enables easier interconnects within the printhead"s logic circuitry, and requires only a single injection of the pulse train from the controller to enable addressing of half the ejector channels in the printhead in two ripples. By sequentially scheduling two ripples each of odd-numbered and even-numbered channels, the preferred architecture provides maximally-spaced channel firings within each 4-channel group, and allows easy 50% area-coverage, checkerboard-type printing for fast, ink-conserving draft printing modes.

The preferred 320-jet, 4-ripple printhead architecture of the current type would address all the 320 channels in four ripples in the following manner, in the case where we start with the odd-numbered channels, and at the low-numbered-channels end of the printhead: With the odd-channel data bits loaded into digital delay line for data 252*a* and latched into the print data storage array 252*b*, the pulse train is injected into and through the digital delay line for pulse train 254*a* and 254*b* in synchronism with Clock 1 to address:

Ripple 1: Heaters 1,5,9, . . . 317 (the AND gates select the heaters with odd numbers), and Ripple 2: Heaters 3,7,11, . . . 318 (the AND gates select the heaters with odd numbers).

During the addressing of the 160 odd-numbered channels, the even-channel print data are injected into the digital delay line for print data 252*a* in synchronism with Clock 1, latched into the print data storage latch 252*b*, and then the pulse train is injected into and through the digital delay line for pulse train 254*a* and 254*b* in synchronism with Clock 1 to address:

Ripple 3: Heaters 2,6,10, . . . 319 (the AND gates select the heaters with even numbers), and Ripple 4: Heaters 4,8,12, . . . 320 (the AND gates select the heaters with even numbers).

Bi-directional printing is desirable in printers with scanning print heads. The preferred 320-jet, 4-ripple architecture would allow the pulse train to move upward or downward through the digital delay line for pulse train 254*a* & 254*b* by utilizing a bi-directional shift register design and including a data director to present the pulse train to the lower or upper end of the pulse train delay line 254*a* & 254*b*. In order to symmetrically reverse the firing sequence of the preferred architecture, means are provided as well to set the odd/even bit, so that if the odd-numbered channels are fired first in the ripple-up printing direction, the even-numbered jets can be fired first in the ripple-down direction. In a preferred embodiment of the preferred printhead architecture, a print mode latch is provided in the printhead to receive mode bits controlling shift direction and odd or even channels first which are sent by the controller via the print data line prior to the first set of print data. In the preferred embodiment, the odd/even bit is automatically toggled following the completion of each 160-channel addressing sequence. Therefore, in the preferred embodiment, the bits controlling ripple direction and odd/even first need be sent only once per printing swath.

While the invention has been described in relation to preferred embodiments, many modifications and variations are apparent from the description of the invention, and all such modifications and variations are intended to be within the scope of the present invention as defined in the appended claims.

What is claimed is:

1. A method of using a thermal ink jet assembly having at least one print head, the print head having a plurality of drop ejectors, each of the plurality of drop ejectors having a heating element actuatable in response to input signals to eject an ink droplet from the print head, the method comprising the steps of:

applying a plurality of print signals to the print head, the plurality of print signals corresponding to an image for the ink jet assembly to create;

applying at least one pulse signal to the print head;

storing the print signal and the at least one pulse signal in multiple connected delay circuit elements prior to sequentially using the at least one pulse signal to activate the heating elements; and sequentially using the at least one pulse signal and the plurality of print signals to activate the heating elements so that a change in a current remains small.

2. The method of claim 1 wherein the change in the current is kept small by increasing or decreasing the number of heating elements activated by no more than one per clock cycle.

3. The method of claim 1, wherein the at least one pulse signal comprises:

at least one prepulse that does not fire the drop ejector; and at least one firing pulse that fires the drop ejector.

4. The method of claim 3, wherein the at least one prepulse is determined based on at least one of a temperature of the print head, a type of ink used, a type of printing to be done and at least one physical characteristic of the print head.

5. The method of claim 1, further comprising the step of controlling characteristics of the at least one pulse signal based on a desired volume of the ink droplet to be ejected from the print head.

6. The method of claim 1, wherein at least one of the timing and duration of the at least one pulse signal is selected such that a volume of the ink droplet is substantially constant over a temperature range of at least 20° C.

7. The method of claim 1, wherein the change in current is kept small by increasing or decreasing the number of heating elements activated by no more than one per cycle of the controlling clock.

8. The method of claim 1, wherein the at least one pulse signal simultaneously activates non adjacent heater elements.

9. The method of claim 8, wherein one or more pulse signals activates non adjacent heater elements.

10. The method of claim 1, wherein the at least one pulse signal comprises:

a main pulse for firing the drop ejector.

11. A thermal ink jet drop ejector, comprising:

a print data storage element that receives print data from a printer controller;

a pulse data element that that receives pulse data from either a print head controller or a previous drop ejector;

a heating element; and multiple connected delay circuit elements that store the print data and the pulse data prior to sequentially using the print data and pulse data to activate the heating elements.

12. The ejector of claim 11 wherein a change in a current is kept small by the pulse data delay element sending the pulse data to the next drop ejector after a one clock cycle delay.

13. The ejector of claim 11, wherein the pulse data comprises:

at least one prepulse that does not fire the drop ejector; and at least one firing pulse that fires the drop ejector.

14. The ejector of claim 13, wherein the at least one prepulse is determined based on at least one of the temperature of the ejector, a type of ink used, a type of printing to be done and a physical characteristic of the ejector.

15. The ejector of claim 11, wherein the pulse data is based on a desired volume of a ink droplet to be ejected from the print head.

16. The ejector of claim 11, wherein at least one of the timing and duration of the at least one pulse signal is selected such that a volume of a ink droplet is substantially constant over a temperature range of at least 20° C.

17. The ejector of claim 11, wherein the combinational elements simultaneously activate non adjacent heater elements.

18. The ejector of claim 11, wherein the pulse data comprises:

at least one main pulse that fires the drop ejector.

19. A method of using a thermal ink jet assembly having at least one print head, the print head having a plurality of drop ejectors, each of the plurality of drop ejectors having a heating element actuatable in response to input signals to eject an ink droplet from the print head, the method comprising the steps of:

applying a plurality of print signals to the print head, the plurality of print signals corresponding to an image for the ink jet assembly to create;

applying at least one pulse signal to the print head according to a pulse and interval signal profile table;

storing the print signal and the at least one pulse signal in multiple connected delay circuit elements prior to sequentially using the at least one pulse signal to activate the heating elements; and sequentially using the at least one pulse signal and the plurality of print signals to activate the heating elements so that a drop volume is relatively constant over a range of temperatures.

20. The method of claim 19, wherein the threshold voltage is additionally maintained relatively constant.

* * * * *